US008042623B2

(12) United States Patent
Quernheim et al.

(10) Patent No.: US 8,042,623 B2
(45) Date of Patent: Oct. 25, 2011

(54) DISTRIBUTED SENSORS-CONTROLLER FOR ACTIVE VIBRATION DAMPING FROM SURFACE

(75) Inventors: Lars Quernheim, Lower Saxony (DE); Dmitriy Dashevskiy, Nienhagen (DE); John D. Macpherson, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 142 days.

(21) Appl. No.: 12/049,492

(22) Filed: Mar. 17, 2008

(65) Prior Publication Data

US 2009/0229882 A1 Sep. 17, 2009

(51) Int. Cl.
*E21B 47/18* (2006.01)

(52) U.S. Cl. ..... 175/26; 175/45

(58) Field of Classification Search ..... 175/26, 175/45

See application file for complete search history.

(56) References Cited

U.S. PATENT DOCUMENTS

| | | | |
|---|---|---|---|
| 4,903,245 A | 2/1990 | Close et al. | |
| 5,448,911 A | 9/1995 | Mason | |
| 6,055,524 A | 4/2000 | Cheng | |
| 7,251,590 B2 | 7/2007 | Huang et al. | |
| 2005/0197777 A1 | 9/2005 | Rodney et al. | |
| 2005/0200498 A1 | 9/2005 | Gleitman | |
| 2007/0289778 A1 * | 12/2007 | Watkins et al. | 175/40 |
| 2009/0216455 A1 * | 8/2009 | Reckmann et al. | 702/9 |

FOREIGN PATENT DOCUMENTS

| | | |
|---|---|---|
| CA | 2424137 A1 | 4/2002 |
| CA | 2424137 C | 4/2002 |
| EP | 0336491 A1 | 11/1989 |
| EP | 0550254 B1 | 10/1996 |
| EP | 0465731 B1 | 8/1997 |
| EP | 0900918 B1 | 11/2003 |
| GB | 2216661 A | 3/1989 |
| GB | 2386389 A | 3/2003 |

OTHER PUBLICATIONS

D.A. Close, et al. "Measurement of BHA Vibration Using MWD". IADC/SPE 17273. Feb. 28-Mar. 2, 1988. pp. 659-668.

S.F. Wolf, et al. "Field Measurements of Downhole Drillstring Vibrations". SPE 14330. Sep. 22-25, 1985. 12 pages.

A. A. Besalsow, et al. "Development of a Surface Drillstring Vibration Measurement System". SPE 14327. Sep. 22-25, 1985. 14 pages.

* cited by examiner

*Primary Examiner* — William P Neuder
(74) *Attorney, Agent, or Firm* — Cantor Colburn LLP

(57) ABSTRACT

An apparatus for controlling a vibration of a drill string, the apparatus including: a plurality of sensors in operable communication with the drill string; and a controller in operable communication with the plurality of sensors, the controller connectable to a drill string motivator and capable of outputting a signal to the drill string motivator to control the vibration of the drill string.

25 Claims, 3 Drawing Sheets

DISTRIBUTED SENSORS-CONTROLLER FOR ACTIVE VIBRATION DAMPING FROM SURFACE

BACKGROUND OF THE INVENTION

1. Field of the Invention

This invention relates to drill strings. More specifically, the invention relates to apparatus and methods for controlling vibrations of the drill strings.

2. Description of the Related Art

Various types of drill strings are deployed in a borehole for exploration and production of hydrocarbons. A drill string generally includes drill pipe and a bottom hole assembly. The bottom hole assembly can be used for drilling, sampling, and logging for example.

While deployed in the borehole, the drill string may be subject to a variety of forces or loads. The loads are generally specific to the borehole being drilled. Because the drill string is in the borehole, the loads are unseen and can affect the dynamic behavior of the drill string. For example, the loads may cause the drill string to vibrate. Vibration at a resonant frequency, in particular, can cause severe vibrations at high amplitudes.

An immediate result of the unseen loads may be unknown. If the loads are detrimental, then continued operation of the drill string might cause damage or unreliable operation. In addition, vibrations can limit the lifetime of components in the drill string.

Traditionally, control of the drilling process is performed by a drill operator or driller. The driller relies on his or her experience to control vibrations in the drill string. However, each borehole presents its own challenges and experience may not be able to prevent damaging vibrations in each case.

Therefore, what are needed are techniques for controlling vibrations of a drill string.

BRIEF SUMMARY OF THE INVENTION

Disclosed is an embodiment of an apparatus for controlling a vibration of a drill string, the apparatus including: a plurality of sensors in operable communication with the drill string; and a controller in operable communication with the plurality of sensors, the controller connectable to a drill string motivator and capable of outputting a signal to the drill string motivator to control the vibration of the drill string.

Also disclosed is an embodiment of a system for controlling a vibration of a drill string, the system including: a drill string; a drill string motivator in operable communication with the drill string; a plurality of sensors in operable communication with the drill string; and a controller in operable communication with the plurality of sensors, the controller connectable to a drill string motivator and capable of outputting a signal to the drill string motivator to control the vibration of the drill string.

Further disclosed is an example of a method for controlling a vibration of a drill string, the method including: receiving a measurement from at least one sensor of a plurality of sensors sensitive to vibration; and transmitting a signal from a controller to a drill string motivator for controlling the vibration of the drill string.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings, wherein like elements are numbered alike, in which:

DETAILED DESCRIPTION OF THE INVENTION

Figure 1:
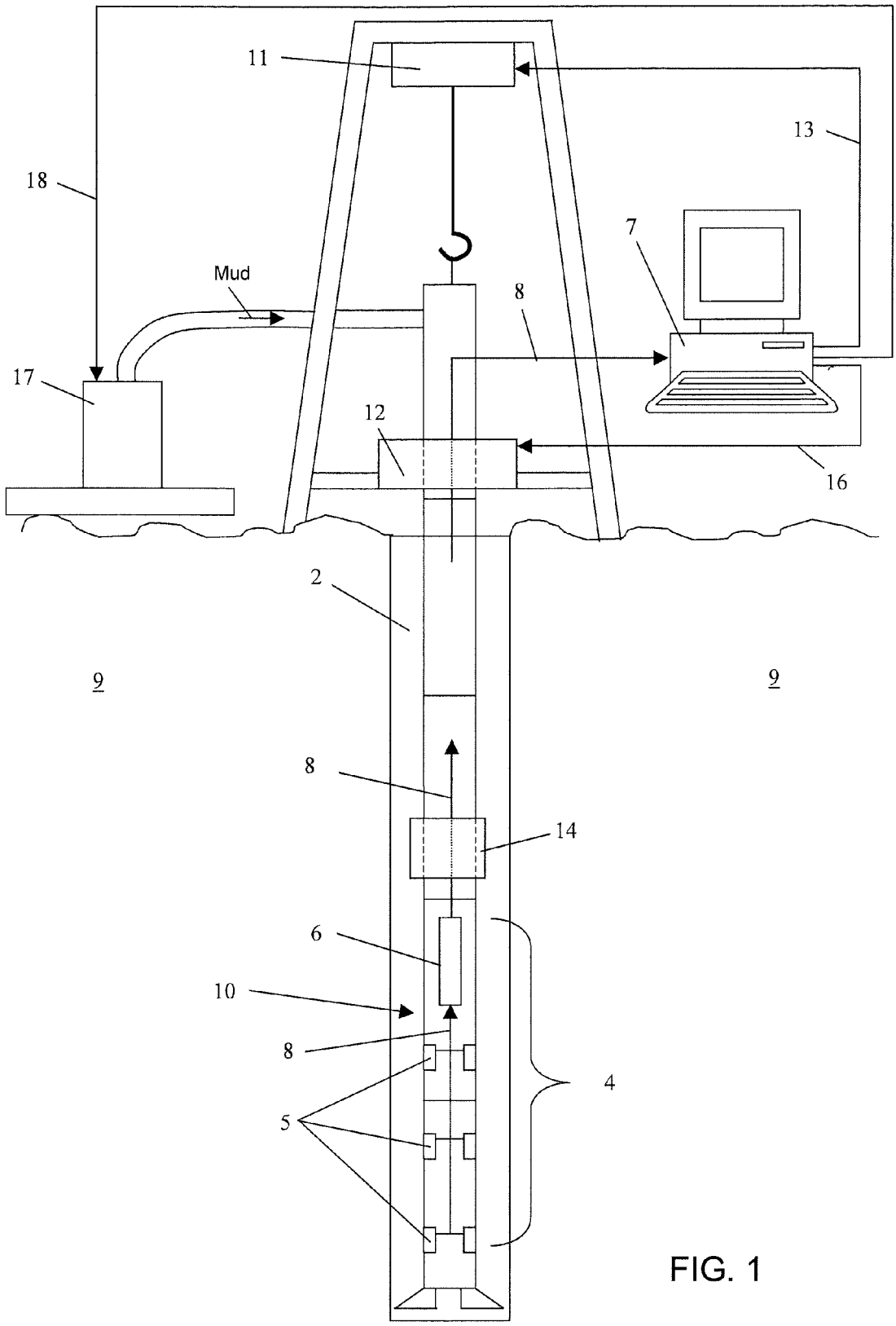
FIG. 1 is an exemplary embodiment of a drill string disposed in a borehole penetrating the earth.

Disclosed are exemplary techniques for controlling oscillations or vibrations of a drill string. The techniques, which include system and methods, use sensors to measure a variety of parameters associated with the vibrations. The parameters are input to a controller that controls the operation of the drill string. Various control structures are used to optimize compensation or dampening of the vibrations.

For convenience, certain definitions are presented for use throughout the specification. The term "drill string" relates to at least one of drill pipe and a bottom hole assembly. In general, the drill string includes a combination of the drill pipe and the bottom hole assembly. The bottom hole assembly may be a drill bit, sampling apparatus, logging apparatus, or other apparatus for performing other functions downhole. As one example, the bottom hole assembly can be a drill collar containing measurement while drilling (MWD) apparatus. The term "vibration" relates to oscillations or vibratory motion of the drill string. Vibration can include vibrations at a resonant frequency of the drill string. Vibration can occur at one or more frequencies and at one or more locations on the drill string. For instance, at one location on the drill string, a vibration at one frequency can occur and at another location, another vibration at another frequency can occur. The term "control the vibration" relates to providing an input to an apparatus or a system that operates the drill string to at least one of decrease an amplitude of the vibration or change the frequency of the vibration. The term "buckling" relates to a deformation of the drill string caused by the drill string not being able to support an imposed force. The term "sticking" relates to a load imposed upon the drill string by the formation that prevents the drill string from being moved with normal force.

The term "distributed sensor system" relates to a plurality of sensors distributed on/within the drill string or operatively associated with the drill string. The distributed sensor system measures parameters associated with the drill string. Non-limiting examples of measurements performed by the sensors include accelerations, velocities, distances, angles, forces, moments, temperatures, pressures, and vibrations. As these sensors are known in the art, they are not discussed in any detail herein. As one example of distribution of sensors, the sensors may be distributed throughout a drill string and tool (such as a drill bit) at the base of the drill string. In addition, the sensors may be distributed on a section of the drill string not disposed in the borehole.

The term "controller" relates to a controller with at least a single input and at least a single output. Non-limiting examples of the type of control performed by the controller include proportional control, integral control, differential control, model based control, observer based control, and state space control. One example of an observer based controller is a controller using an observer algorithm to estimate internal states of the drill string using input and output measurements that do not measure the internal state. In some instances, the controller can learn from the measurements obtained from the distributed control system to optimize a control strategy. The term "observable" relates to performing one or more measurements of parameters associated with the motion of the drill string wherein the measurements enable a mathematical model or an algorithm to estimate other parameters of the drill string that are not measured. The term "state" relates to a set of parameters used to describe the drill string at some moment in time.

The term "drill string motivator" relates to the apparatus or the system that is used to operate the drill string. Non-limiting examples of a drill string motivator include a "hook system" for supporting the drill string, a "rotary device" for rotating the drill string, and a "mud pump" for pumping drilling mud through the drill string. The term "behavior" relates to at least one of a condition of the drill string, a motion or change in motion of the drill string, and a reaction to an excitation or force imposed upon the drill string.

Referring to FIG. 1, a simplified example of a drill string 10 is shown disposed in a borehole 2 penetrating the earth 9. A distributed sensor system (DSS) 4 is shown disposed on the drill string 10. In the embodiment of FIG. 1, the DSS 4 includes a plurality of sensors 5. The sensors 5 perform measurements associated with the motion of the drill string 10. The sensors 5 are generally coupled to a downhole electronics unit 6. The downhole electronics unit 6 receives data 8 from the sensors 5 and transmits the data 8 to a controller 7. The data 8 includes measurements from the sensors 5. In some embodiments, the downhole electronics unit 6 can multiplex the data for transmission to the controller 7. The controller 7 may be disposed at least one of at the surface of the earth 9 as shown in FIG. 1 and in the borehole 2. Further, the controller 7 may provide distributed control by being distributed with the sensors 5. Various techniques may be used to transmit the data 8 to the controller 7 such as mud pulse, electromagnetic telemetry, acoustic telemetry, or "wired pipe."

In one embodiment of wired pipe, the drill pipe portion of the drill string 10 is modified to include a broadband cable protected by a reinforced steel casing. At the end of each drill pipe, there is an inductive coil, which contributes to communication between two drill pipes. In this embodiment, the broadband cable is used to transmit the data 8 to the controller 7. About every 500 meters, a signal amplifier is disposed in operable communication with the broadband cable to amplify the data to account for signal loss. The controller 7 receives the data 8 from the drill pipe at the surface of the earth 9 in the vicinity of the borehole 2 or other desired remote location.

One example of wired pipe is INTELLIPIPE® commercially available from Intellipipe of Provo, Utah, a division of Grant Prideco. Intellipipe has data transfer rates from fifty-seven thousand bits per second to one million bits per second.

Wired pipe is one example of high speed data transfer. The high speed data transfer enables sampling rates of the measured parameters at up to 200 Hz or higher with each sample being transmitted to the surface of the earth 9. Because of the high speed data transfer, many sensors 5 can be used to measure the parameters associated with the drill string 10 and input to the controller 7.

Various configurations of the distributed sensor system 4 may be used. For example, the embodiment of FIG. 1 includes the plurality of sensors 5, however, in other embodiments one sensor 5 may be used. As another example, the embodiment of FIG. 1 includes the downhole electronics unit 6, however, in other embodiments the downhole electronics unit 6 may not be used wherein the sensors 5 may transmit the data 8 directly to the controller 7.

Turning now to the controller 7, the controller 7 may include a computer processing system. Exemplary components of the computer processing system include, without limitation, at least one processor, storage, memory, input devices, output devices and the like. As these components are known to those skilled in the art, these are not depicted in any detail herein.

Generally, some of the teachings herein are reduced to an algorithm that is stored on machine-readable media. The algorithm is implemented by the computer processing system and provides operators with desired output.

Again referring to FIG. 1, a hook system 11, a rotary device 12, and a mud pump system 17 are depicted. The rotary device 12 can be any device for turning or rotating the drill string 10. Examples of the rotary device 12 include a "rotary table" and a "topdrive." At least one of torque and rotary speed are adjustable with rotary device 12. The hook system 11 is used to support the drill string 10. When using the topdrive, the hook system 11 may be used to support the topdrive, which in turn supports the drill string 10. A force exerted by the hook system 11 on the drill string 10 is adjustable. The mud pump system 17 pumps drilling mud through the drill string 10. Auxiliary components such as control valves may be included in the mud pump system 17. At least one of mud pump speed and control valve setting may be adjusted to control a mud flow rate. In accordance with the techniques presented herein, the hook system 11 can receive a hook control signal 13 from the controller 7 to control the force. Similarly, the rotary device 12 receives a rotary device control signal 16 from the controller 7 to control at least one of torque and rotary speed; and the mud pump system 17 receives a mud pump control signal 18 from the controller 7 to control the mud flow rate.

Figure 2:
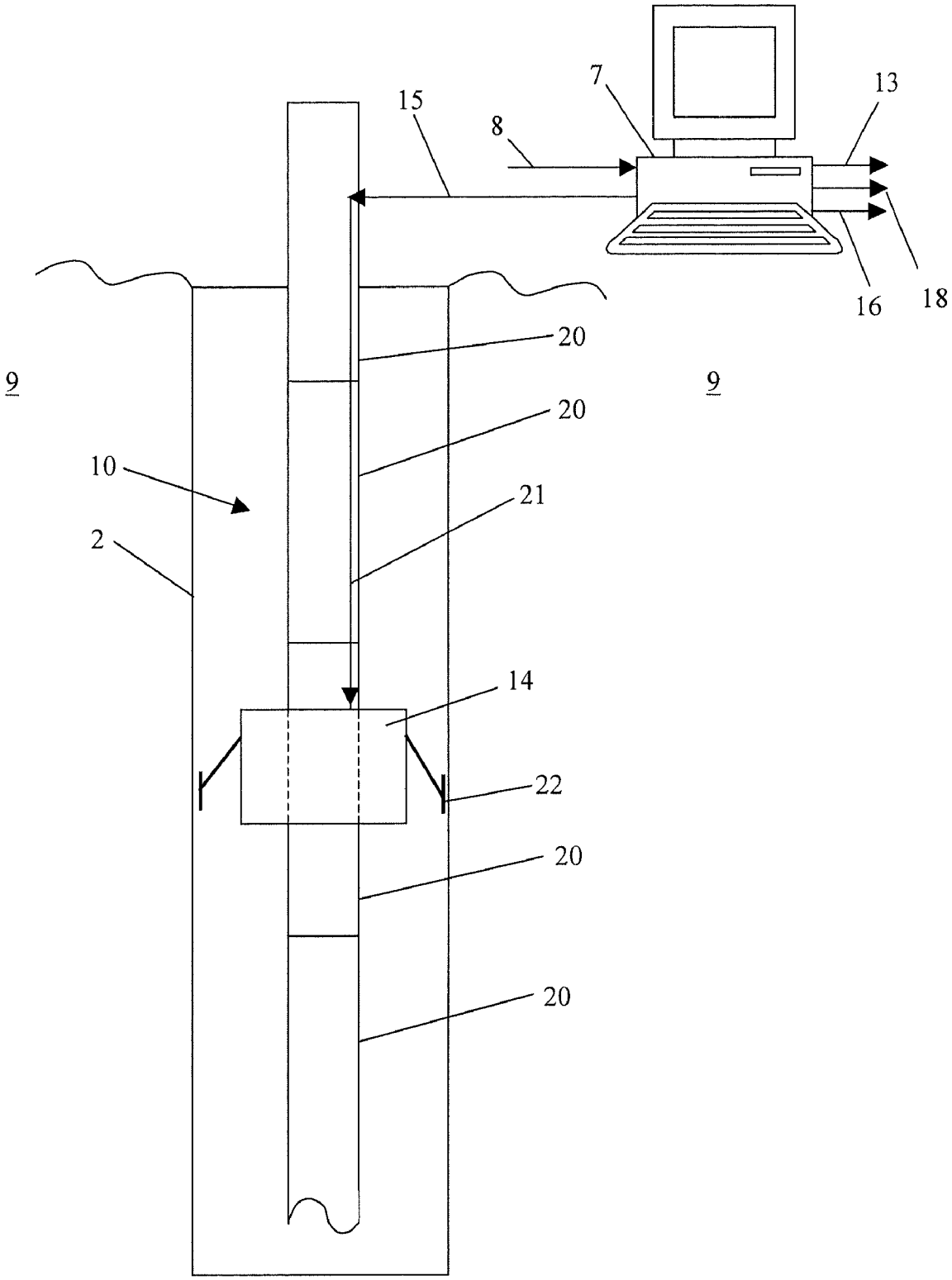
FIG. 2 depicts aspects of an active vibration control device.

In the embodiment of FIG. 1, an active vibration control device 14 is disposed on the drill string 10 in the borehole 2. FIG. 2 depicts aspects of the active vibration control device 14. Referring to FIG. 2, the active vibration control device 14 receives a vibration control device signal 15 from the controller 7 via wired pipe 20 to control vibration of the drill string 10. The wired pipe 20 includes conductors 21 for transmitting the data 8 to the controller 7 and for transmitting the vibration control device signal 15 to the vibration control device 14. In one embodiment, the active vibration control device 14 extends at least one vibration control element 22 from the device 14 to the wall of the borehole 2 to control the vibration. The device 14 may include vibration absorbing apparatus such as hydraulic shock absorbers and vibration damping materials that can compress or stretch to dampen vibrations.

Returning to the controller 7, the controller 7 may provide at least one of proportional control, integral control, derivative control, model based control, observer based control, and state space control. At least a single input and a single output are included in the controller 7.

In another embodiment, the controller 7 can include a multiple input-multiple output (MIMO) controller. The MIMO controller generally includes a mathematical model or algorithm that receives measurements from the plurality of sensors 5. The algorithm can perform several functions using the measurements. For example, the algorithm can evaluate different measurements and provide a weight to each measurement for use in determining an optimal control signal (such as for at least one of the hook control signal 13, the rotary device control signal 16, the mud pump control signal 18, and the vibration control device signal 15). This differentiating of measurements by weighting can be used to increase the processing speed of the controller 7 because the controller 7 will not have to use each measurement to determine the optimal control signal. Depending on the embodiment of the algorithm, the algorithm can operate in the time domain or the frequency domain.

Another function that the MIMO controller can perform is refining the mathematical model or algorithm. A refinement algorithm may be used to optimize the control algorithm used for providing control of vibration. The control algorithm uses equations to model the behavior of the drill string 10. The equations generally include mathematical parameters that can be adjusted from the data 8 using regression analysis such as least squares for example. Regression analysis is used to model numerical data obtained from observations (such as the data 8) by adjusting the mathematical parameters to get an optimal fit of the data. With least squares, the optimal fit corresponds to the mathematical parameters that provide the least value of the sum of the squares of the differences between the observed values and the modeled values.

The MIMO controller can also be used to identify critical events during the drilling process by using various signal processing techniques. The techniques include using at least one band-pass filter to separate the data 8 into different frequency ranges. The techniques can include receiving vibration measurements from sensors 5 disposed at a drill string motivator. The band-pass filter can be used to isolate the excitation vibrations caused by the drill string motivator (such as at least one of the hook system 11, the rotary device 12, and the mud pump system 17) from the vibrations measured on the drill string 10. Thus, the MIMO controller can account for the excitation vibrations and quantify resonant frequency vibrations. In addition, the MIMO controller can identify well characteristics and parameters of the drill string 10 such as masses, elasticity, mud-damping factor, inertia of the drill string, and friction losses. Alternatively, the MIMO controller can use at least one of these well characteristics and parameters as input to determine another well characteristic or parameter. One benefit of the MIMO controller is that by identifying these characteristics and drill string 10 parameters, the controller 7 and the drilling process can be adapted to specific environmental conditions.

The identification process can use an observer algorithm to estimate states of the drill string 10 not measured by the sensors 5. An example of a state not measured is an acceleration of a section of the drill string 10 not measured by the distributed sensor system 4. The states can represent any variable that is not measured by the distributed sensor system 4. The observer algorithm requires that the number of sensors 5, the types of sensors 5, and the locations of the sensors 5 be such that the drill string 10 is observable with respect to the characteristics to be identified. For linear systems, examples of the observer algorithm include a Kalman filter and Luenberger observer. For nonlinear systems, examples of the observer algorithm include an Extended Kalman Filter and an Unscented Kalman filter. The Extended Kalman filter converts all nonlinear models to linear models so that the traditional Kalman filter can be applied. For highly nonlinear systems, the Unscented Kalman filter generally provides more accurate estimates than the Extended Kalman filter.

In one embodiment of the MIMO controller, the MIMO controller includes multiple observer algorithms or filters wherein each algorithm or filter is used for a separate task. When the MIMO controller uses multiple filters, measurements in the data 8 can be grouped together by task. Using multiple filters and grouping of the measurements can provide for faster control and processing by the controller 7 incorporating the MIMO controller.

One benefit of the using the faster control and processing is being able to control the drill string 10 in an acceptable stability range when complete damping of oscillations of the drill string 10 cannot be achieved. In the acceptable stability range, oscillations of the drill string 10 occur, but the amplitude of the oscillations does not harm the drill string 10.

The functions of the SISO controller and the MIMO controller described above can be included separately or in combination in the controller 7.

The observer algorithm can be run in "real time" to provide real time control of vibrations of the drill string 10. As used herein, generation of the data 8 in "real-time" is taken to mean generation of the data 8 at a rate that is useful or adequate for providing control of the vibrations of the drill string 10. Accordingly, it should be recognized that "real-time" is to be taken in context, and does not necessarily indicate the instantaneous determination of the data 8 or instantaneous control of the drill string 10, or make any other suggestions about the temporal frequency of data collection and determination.

A high degree of quality control over the data 8 may be realized during implementation of the teachings herein. For example, quality control may be achieved through known techniques of iterative processing and data comparison. Accordingly, it is contemplated that additional correction factors and other aspects for real-time processing may be used. Advantageously, the user may apply a desired quality control tolerance to the data 8, and thus draw a balance between rapidity of determination of the data 8 and a degree of quality in the data 8.

Figure 3:
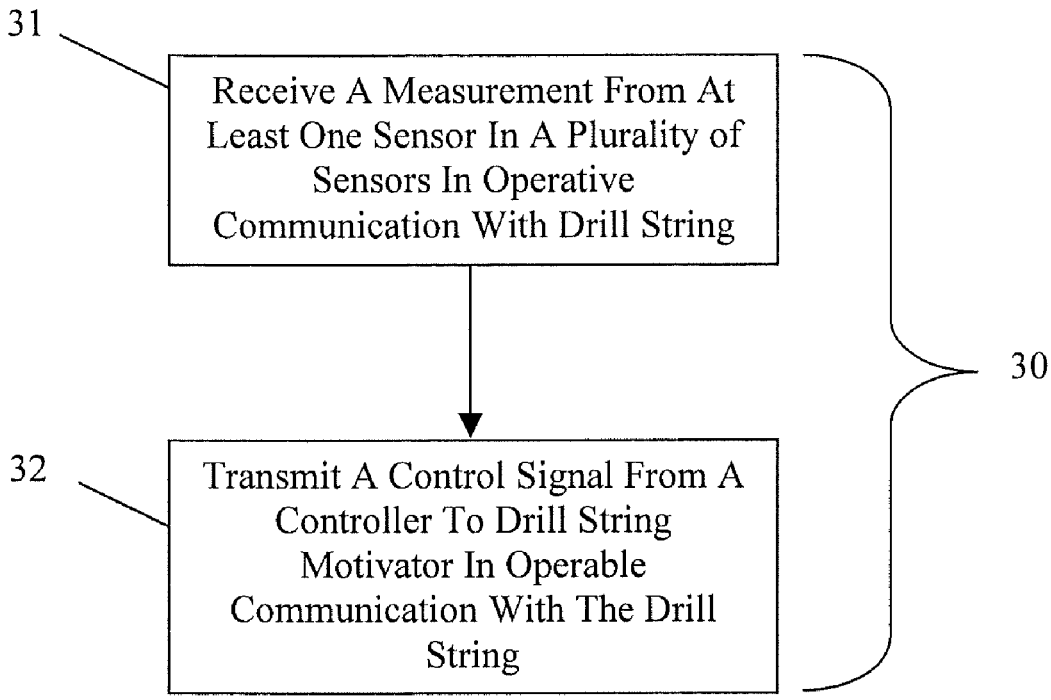
FIG. 3 presents an example of a method for controlling vibrations of the drill string.

FIG. 3 presents one example of a method 30 for controlling a vibration of the drill string 10. The method 30 calls for (step 31) receiving a measurement from at least one sensor in the plurality of sensors 5 operatively associated with the drill string 10. Further, the method 30 calls for (step 32) transmitting a signal from the controller 7 to the drill string motivator for controlling the vibration of the drill string.

In support of the teachings herein, various analysis components may be used, including digital and/or analog systems. The digital and/or analog systems may be included in the downhole electronics unit 6 or the controller 7 for example. The system may have components such as a processor, analog to digital converter, digital to analog converter, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing for aspects of the teachings herein. For example, a power supply (e.g., at least one of a generator, a remote supply and a battery), cooling component, heating component, motive force (such as a translational force, propulsional force, or a rotational force), digital signal processor, analog signal processor, sensor, magnet, antenna, transmitter, receiver, transceiver, controller, optical unit, electrical unit or tromechanical unit may be included in support of the various aspects discussed herein or in support of other functions beyond this disclosure.

Elements of the embodiments have been introduced with either the articles "a" or "an." The articles are intended to mean that there are one or more of the elements. The terms "including" and "having" are intended to be inclusive such that there may be additional elements other than the elements listed. The term "or" when used with a list of at least two elements is intended to mean any element or combination of elements.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus for controlling a vibration of a drill string, the apparatus comprising:

a plurality of sensors in operable communication with the drill string; and a controller in operable communication with the plurality of sensors, the controller connectable to a drill string motivator and capable of outputting a signal to the drill string motivator to control the vibration of the drill string, wherein the drill string motivator is disposed at the surface of the earth.

2. The apparatus as in claim 1, wherein the drill string motivator is at least one of a hook system to support the drill string, a rotary device to rotate the drill string, and a mud pump in operative communication with the drill string.

3. The apparatus as in claim 1, wherein the sensors are sensitive to at least one of force, moment, acceleration, stress, strain, velocity, distance, angle, pressure, temperature, and vibration.

4. The apparatus as in claim 1, wherein the signal comprises a value for at least one of:

a force to be exerted upon the drill string;

a torque to be exerted upon the drill string;

a rotational velocity at which the drill string is to be rotated; and a mud flow rate.

5. The apparatus as in claim 1, wherein the controller comprises at least one of:

proportional control;

integral control;

differential control;

model based control;

observer based predictive control; and state space control.

6. The apparatus as in claim 1, wherein the controller comprises an algorithm for modeling a behavior of the drill string.

7. The apparatus as in claim 6, wherein the algorithm at least one of determines and utilizes at least one of a mass of the drill string, an elasticity of the drill string, a mud damping factor affecting the drill string, inertia of the drill string, and friction losses.

8. The apparatus as in claim 1, wherein the controller comprises an observer algorithm.

9. The apparatus as in claim 8, wherein the observer algorithm comprises at least one of a Kalman filter, an Extended Kalman filter, an Unscented Kalman filter, and a Luenberger observer.

10. The apparatus as in claim 1, wherein the controller comprises an algorithm and a parameter refinement algorithm to update a parameter in the algorithm using at least one measurement from at least one sensor.

11. The apparatus as in claim 1, wherein the controller comprises at least two band-pass filters wherein each filter provides a frequency range different from the other filter.

12. The apparatus as in claim 1, wherein a set of sensors within the plurality of sensors is disposed along the drill string.

13. The apparatus as in claim 1, wherein the controller comprises a band-pass filter to identify excitation vibration from the drill string motivator.

14. A system for controlling a vibration of a drill string, the system comprising:

a drill string;

a drill string motivator in operable communication with the drill string and disposed at the surface of the earth;

a plurality of sensors in operable communication with the drill string; and a controller in operable communication with the plurality of sensors, the controller connectable to the drill string motivator and capable of outputting a signal to the drill string motivator to control the vibration of the drill string.

15. The system as in claim 14, further comprising an active vibration control device disposed at the drill string, the active vibration control device in operable communication with the controller.

16. The system as in claim 14, wherein the sensors are sensitive to at least one of force, moment, acceleration, stress, strain, velocity, distance, angle, pressure, temperature, and vibration.

17. A method for controlling a vibration of a drill string, the method comprising:

receiving a measurement with a controller from at least one sensor in a plurality of sensors in operative communication with the drill string; and transmitting a signal from the controller to a drill string motivator for controlling the vibration of the drill string, wherein the drill string motivator is disposed at the surface of the earth.

18. The method as in claim 17, further comprising transmitting the signal to an active vibration control device disposed at the drill string.

19. The method as in claim 17, wherein the measurement comprises at least one of force, moment, acceleration, stress, strain, velocity, distance, angle, pressure, temperature, and vibration.

20. The method as in claim 17, further comprising estimating a state of the drill string.

21. The method as in claim 20, further comprising identifying at least one of buckling and sticking of the drill string.

22. The method as in claim 20, further comprising determining at least one of a mass of the drill string, an elasticity of the drill string, a mud-damping factor affecting the drill string, inertial of the drill string, and friction losses.

23. The method as in claim 17, further comprising refining parameters of an algorithm in the controller using the measurement.

24. The method as in claim 17, further comprising organizing measurements from the sensors into groups.

25. The method as in claim 17, wherein the method is implemented by machine-executable instructions stored on machine-readable media.

* * * * *